US008552823B2

(12) United States Patent
Isonaga

(10) Patent No.: US 8,552,823 B2
(45) Date of Patent: Oct. 8, 2013

(54) ELECTROMAGNETIC RELAY

(75) Inventor: Taisuke Isonaga, Atsugi (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 0 days.

(21) Appl. No.: 13/805,072

(22) PCT Filed: Jun. 17, 2011

(86) PCT No.: PCT/JP2011/003469

§ 371 (c)(1),
(2), (4) Date: Dec. 18, 2012

(87) PCT Pub. No.: WO2011/161919

PCT Pub. Date: Dec. 29, 2011

(65) Prior Publication Data

US 2013/0088312 A1 Apr. 11, 2013

(30) Foreign Application Priority Data

Jun. 21, 2010 (JP) ..... 2010-140321
Apr. 22, 2011 (JP) ..... 2011-096197

(51) Int. Cl.
*H01H 67/02* (2006.01)
*H01F 7/00* (2006.01)

(52) U.S. Cl.
USPC ..... 335/126; 335/265

(58) Field of Classification Search
USPC ..... 335/126, 184, 203, 119, 232, 242, 265; 251/129.15
See application file for complete search history.

(56) References Cited

U.S. PATENT DOCUMENTS

| | | | | | |
|---|---|---|---|---|---|
| 2,417,728 | A * | 3/1947 | Baylis | 335/38 |
| 3,914,720 | A * | 10/1975 | Drubig | 335/14 |
| 4,931,758 | A * | 6/1990 | Bagalini | 335/174 |
| 5,422,617 | A * | 6/1995 | Brown | 335/267 |
| 6,047,718 | A * | 4/2000 | Konsky et al. | 137/1 |
| 6,204,742 | B1 * | 3/2001 | Hisamoto et al. | 335/126 |
| 6,677,844 | B1 * | 1/2004 | Gorospe et al. | 335/220 |
| 2009/0243771 | A1 | 10/2009 | Uruma et al. | |
| 2009/0284335 | A1 | 11/2009 | Kim et al. | |

FOREIGN PATENT DOCUMENTS

| | | | |
|---|---|---|---|
| JP | 2006-185816 | A | 7/2006 |
| JP | 2009-277654 | A | 11/2009 |
| JP | 2010-10058 | A | 1/2010 |
| WO | WO 2007/060945 | A1 | 5/2007 |

* cited by examiner

*Primary Examiner* — Alexander Talpalatski
(74) *Attorney, Agent, or Firm* — Foley & Lardner LLP

(57) ABSTRACT

An electromagnetic relay includes a fixed iron core; a movable iron core disposed opposing to the fixed iron core; a coil for generating a magnetic force when energized to make the movable iron core attracted by the fixed iron core; a movable contact coupled with the movable iron core; a fixed contact disposed opposing to the movable contact; and a reset spring for resetting the movable iron core when the coil is de-energized. The movable iron core includes a base body to which an expanding force of the reset spring is applied and a movable member provided independently from the base body. The movable member is attracted by the fixed iron core when the coil is energized to move integrally with the base body, and is reset by the expanding force of the reset spring when the coil is de-energized to slide independently from the base body.

6 Claims, 5 Drawing Sheets

ELECTROMAGNETIC RELAY

TECHNICAL FIELD

The present invention relates to an electromagnetic relay that can be effectively used in control circuits of various electrical devices, such as a control circuit for driving a motor of an electric vehicle.

BACKGROUND ART

A conventional electromagnetic relay is disclosed in a Patent Literature 1 (PTL 1) listed below. The disclosed electromagnetic relay is a polarized electromagnetic relay that intends to reducing power consumption during operation and to improve resetting movement of a movable iron core by providing a permanent magnet with the iron core.

CITATION LIST

Patent Literature

PTL 1: Japanese Patent Application Laid-Open No. 2010-10058

SUMMARY OF INVENTION

Technical Problem

In an electromagnetic relay, an iron core is reset by a reset spring when the relay is de-energized, so that undesirable noise and vibration may be generated due to a contact of the iron core and an end plate of a yoke.

Solution to Problem

Therefore, this tendency may become more noticeable when quickly resetting an iron core as disclosed in the above Patent Literature 1.

An object of the present invention provides an electromagnetic relay that can restrict noise and vibration on its de-energization without affecting its operational performance on its energization and de-energization.

An aspect of the present invention provides an electromagnetic relay that includes a fixed iron core; a movable iron core that is disposed opposing to the fixed iron core and can contact-with or separate-from the fixed iron core along an axial direction; a coil that surrounds the fixed iron core and the movable iron core and generates a magnetic force when energized to make the movable iron core attracted by the fixed iron core; a movable contact coupled with the movable iron core; a fixed contact that is disposed opposing to the movable contact and can be contacted-with or distanced-from the movable contact along with a movement of the movable iron core; and a reset spring that is interposed between the fixed iron core and the movable iron core and separates the movable iron core from the fixed iron core when the coil is de-energized. The movable iron core includes a base body to which an expanding force of the reset spring is applied and a movable member that is provided independently from the base body. The movable member is configured to be moved to the fixed iron core integrally with the base body in the axial direction when the coil is energized, and to move in the axial direction to slide independently from the base body when the coil is de-energized.

DESCRIPTION OF EMBODIMENTS

Embodiments will be explained hereinafter with reference to the drawings.

Figure 1:
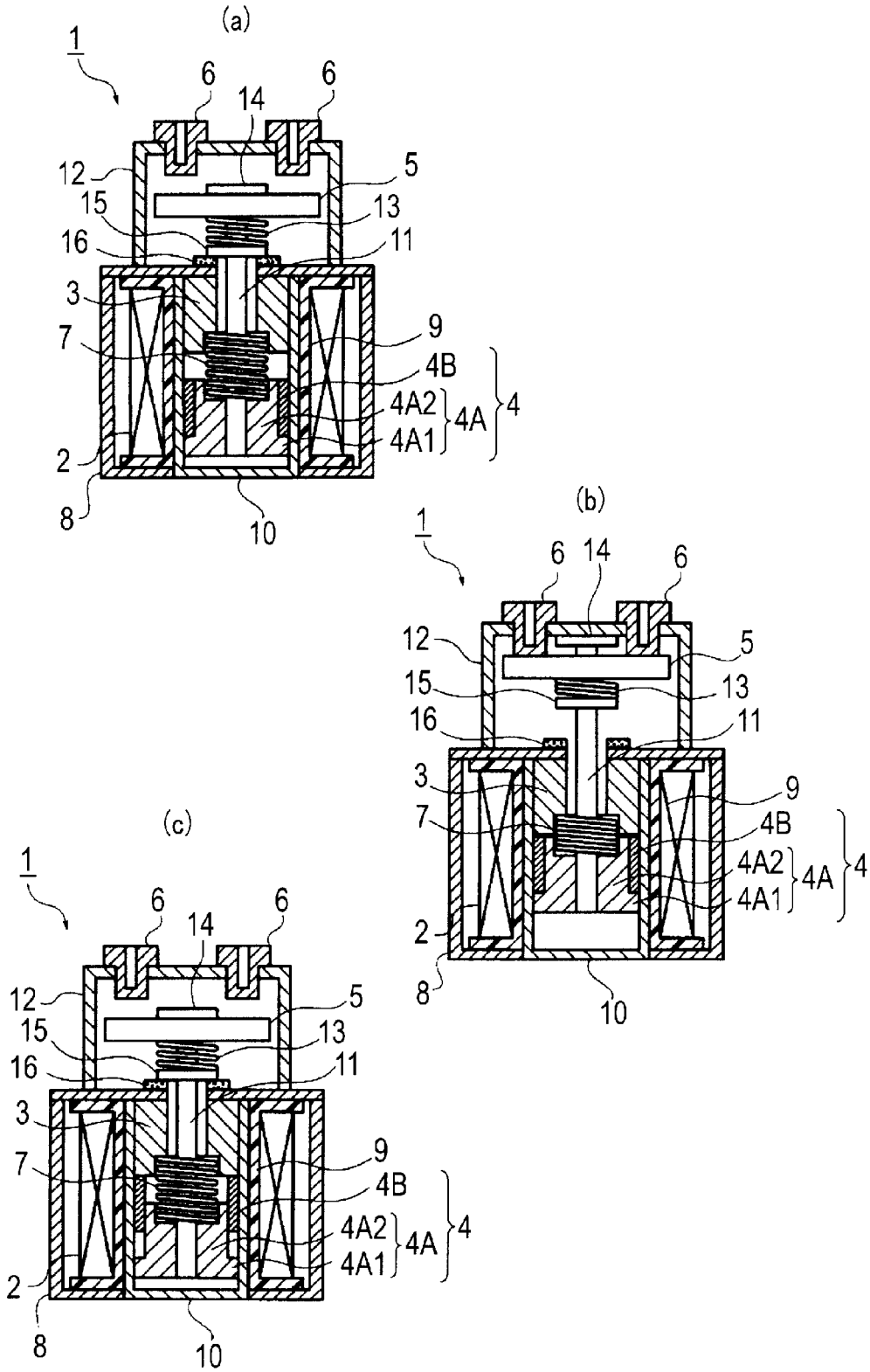
FIG. 1 is an explanatory cross-sectional schematic drawing showing an electro-magnetic relay according to a first embodiment: (a) shows its de-energized state, (b) shows its energization operation and (c) shows its de-energization operation.

As shown in FIG. 1(*a*), an electromagnetic relay 1 according to a first embodiment includes a magnetizing coil 2, a fixed iron core 3, a movable iron core 4, a movable contact 5, fixed contacts 6, and a reset spring 7. The fixed iron core 3 and the movable iron core 4 are to be magnetized due to excitation of the magnetizing coil 2. The movable contact 5 is coupled with the movable iron core 4. The movable contact 5 and fixed contacts 6 face each other. The reset spring 7 is disposed between the fixed iron core 3 and the movable iron core 4.

The coil 2 is wound around a bobbin 9 that is inserted in a yoke 8. An iron core case 10 is inserted in the bobbin 9.

The iron core case 10 is formed as a bottomed cylinder. The fixed iron core 3 is fixedly disposed at an upper end in the iron core case 10.

The movable iron core 4 is disposed below the fixed iron core 3 within the iron core case 10, and can slide vertically in the iron core case 10. The movable iron core 4 faces the fixed iron core along an axial direction, and can be contacted-with/separated-form the fixed iron core 3.

A counterbore is formed at a center of a facing plane of each of the fixed iron core 3 and the movable iron core 4. The reset spring 7 is interposed between the counterbores, and its both ends are fixed to the counterbores, respectively.

A rod 11 is vertically fixed at a center of the movable iron core 4. The rod 11 penetrates through a center of the fixed iron core 3 and the upper end plate of the yoke 8, and protrudes into an inside of a shield case 12 that is fixed on the upper end plate.

The fixed contacts 6 are disposed so as to penetrate an upper wall of the shield case 12 vertically. On the other hand, the movable contact 5 is disposed, in the shield case 12, at a top of the rod 11 with supported by a pressure-applying spring 13. The pressure-applying spring 13 is to apply a contacting pressure force to the movable contact 5.

Specifically, the movable contact 5 are movably supported between a stopper 14 fixed at a top end of the rod and the pressure-applying spring 13. The pressure-applying spring 13 is interposed between a spring seat 15 fixed to the rod 11 and the movable contact 5.

In the electromagnetic relay 1 configured as above, the fixed iron core 3 and the movable iron core 4 are magnetized when a magnetic force is generated by the coil 2 due to energization. Then, the fixed iron core 3 and the movable iron core 4 attract each other, so that the movable iron core 4 and the movable contact 5 are integrally moved in the axial direction. As a result, the movable contact 5 contacts with the fixed contacts 6 to connect desired circuits (FIG. 1(*b*)).

The magnetization of the fixed iron core 3 and the movable iron core 4 are cancelled immediately when the coil 2 is demagnetized due to de-energization. Then, the fixed iron core 3 and the movable iron core 4 are separated away with each other due to an expanding force of the reset spring 7, so that the movable iron core 4 and the movable contact 5 are integrally moved back in the axial direction. As a result, the movable contact 5 is separated away from the fixed contacts 6 to disconnect the above-mentioned circuits (FIG. 1(*c*)).

If the contacts 5 and 6 are instantaneously separated away from each other due to an external force while the contacts 5 and 6 should be contacted with each other, arc currents may be generated between the contacts 5 and 6. Then, the contacts 5 and 6 may be welded together when recontacted with each other.

In addition, if the contacts 5 and 6 are not quickly separated with each other on disconnecting the above-mentioned circuits, arc currents may be generated between the contacts 5 and 6. As a result, the circuits cannot be disconnected smoothly and quickly.

Namely, while the contacts 5 and 6 are contacted with each other, it is required that the fixed iron core 3 and the movable iron core 4 firmly attract each other to keep their contacted state. When the contacts 5 and 6 are to be separated from each other from their contacted state, it is required that the contacts 5 and 6 are smoothly and quickly separated from each other.

On the other hand, when the contacts 5 and 6 are separated from each other, the spring seat 15 on the rod 11 contacts with the upper end plate of the yoke 8 and thereby vibration may be generated. In a case where the electromagnetic relay 1 is applied to a control circuit for driving a motor of an electric vehicle, the vibration may be transmitted to a vehicle body and give undesirable feeling to occupants. Here, a gum damper (cushioning member) 16 is provided at a position contacted with the spring seat 15 on the upper end plate of the yoke 8, but the gum damper 16 cannot absorb an impact by the spring seat 15 completely.

To solve these problems, it can be considered to downsize a magnetizing portion of the movable iron core 4, to reduce a spring force of the reset spring 7 and so on. However, if the magnetizing portion of the movable iron core 4 is downsized, a magnetic force of the magnetized movable iron core 4 becomes weak and thereby the contacting pressure becomes insufficient to keep contacting state of the contacts 5 and 6. In addition, if the spring force of the reset spring 7 is reduced, a force for separating the movable iron core 4 away from the fixed iron core 3 on the de-energization becomes weak and thereby the movable iron core 4 cannot be separated smoothly and quickly.

Therefore, the movable iron core 4 is composed of a base body 4A to which the expanding force of the reset spring 7 applies and a movable member 4B that can slide separately with the base body 4A. The movable member 4B can slide in the axial direction integrally with the base body 4A due to the excitation of the coil 2, and then the base body 4A and the movable member 4B contact with the fixed iron core 3, and can slide in the axial direction independently from the base body 4A after the coil 2 is demagnetized.

In the present embodiment shown in FIG. 1, the base body 4A has a stepped cylindrical shape formed of a flange 4A1 and a small-diameter portion 4A2. The flange 4A1 has an outer diameter identical to a fundamental outer diameter of the movable iron core 4. The small-diameter portion 4A2 has an outer diameter smaller than the fundamental outer diameter of the movable iron core 4 and larger than an outer diameter of the reset spring 7. The movable member 4B has a pipe shape and is slidably fit around the small-diameter portion 4A2. Thickness of the movable member 4B is almost identical to radial width of the flange 4A1, and a height (length) of the movable member 4B is identical to a height (length) of the small-diameter portion 4A2.

According to the electromagnetic relay 1 as configured above, the movable member 4B stays at an initial position due to its own weight while the electromagnetic relay 1 is de-energized as shown in FIG. 1(*a*). The movable member 4B at the initial position stays on the flange 4A1.

When the coil 2 is energized to generate magnetic force from the above de-energized state, the fixed iron core 3 and the movable iron core 4 are magnetized and then the movable iron core 4 is attracted to the fixed iron core 3.

At this process, the movable member 4B is pushed by the flange 4A1, so that the movable member 4B slides integrally with the base body 4A toward the fixed iron core 3 in the axial direction.

The movable iron core 4 has slid toward the fixed iron core 3 by a predetermined stroke amount, so that the movable contact 5 contacts with the fixed contact 6. Also, both of the base body 4A and the movable member 4B of the movable iron core 4 are attracted to the fixed iron core 3 as shown in FIG. 1(*b*) to compress the pressure-applying spring 13 and to apply the contacting pressure between the contacts 5 and 6. Even when the movable iron core 4 is configured to be divided into the base body 4A and the movable member 4B as described above, both of the base body 4A and the movable member 4B are integrally attracted to the fixed iron core 3 and then integrally contact with the fixed iron core 3 on energizing the electromagnetic relay 1. Therefore, the contacting pressure between the contacts 5 and 6 is not affected at all.

When the coil 2 is demagnetized due to de-energization from the energized state of the electromagnetic relay 1 shown in FIG. 1(*b*), magnetization of the fixed iron core 3 and the movable iron core 4 (the base body 4A and the movable member 4B) is cancelled. Therefore, the base body 4A is quickly moved downward in the axial direction by the expanding force of the reset spring 7 (and a supplemental expanding force of the pressure-applying spring 13), so that the base body 4A is quickly separated from the fixed iron core 3 without reducing separation speed between the contacts 5 and 6. On the other hand, the movable member 4B drops downward in the axial direction due to its own weight with a time-delay as shown in FIG. 1(*c*), so that the movable member 4B separates from the fixed iron core 3 in retard of the base body 4A. Therefore, a mass to be separately moved by the reset spring 7 is a mass of the base body 4A that is smaller than a whole mass of the movable iron core 4. As a result, an impact between the spring seat 15 and the gum damper 16 is reduced.

According to the electromagnetic relay 1 in the present embodiment, the base body 4A of the movable iron core 4 is quickly separated from the fixed iron core 3 by the expanding force of the reset spring 7 to separate the contacts 5 and 6 on its de-energization, but the movable member 4B of the movable iron core 4 separates from the fixed iron core 3 due to its own weight. Therefore, there is the time-delay between the divided iron cores 4A and 4B. Consequently, since a mass to be separately moved by the reset spring 7 is a mass of the base body 4A that is smaller than a whole mass of the movable iron core 4, noise and vibration due to a contact of the spring seat 15 and the upper end plate of the yoke 8 are reduced.

Both of the base body 4A and the movable member 4B of the movable iron core 4 are magnetized and attracted to the fixed iron core 3 on the energization of the electro-magnetic relay 1, so that the contacting pressure between the contacts is not subject to decrease.

Therefore, according to the electromagnetic relay 1 in the present embodiment, noise and vibration on its de-energization can be restricted without affecting its operational performance on its energization and de-energization at all.

Figure 2:
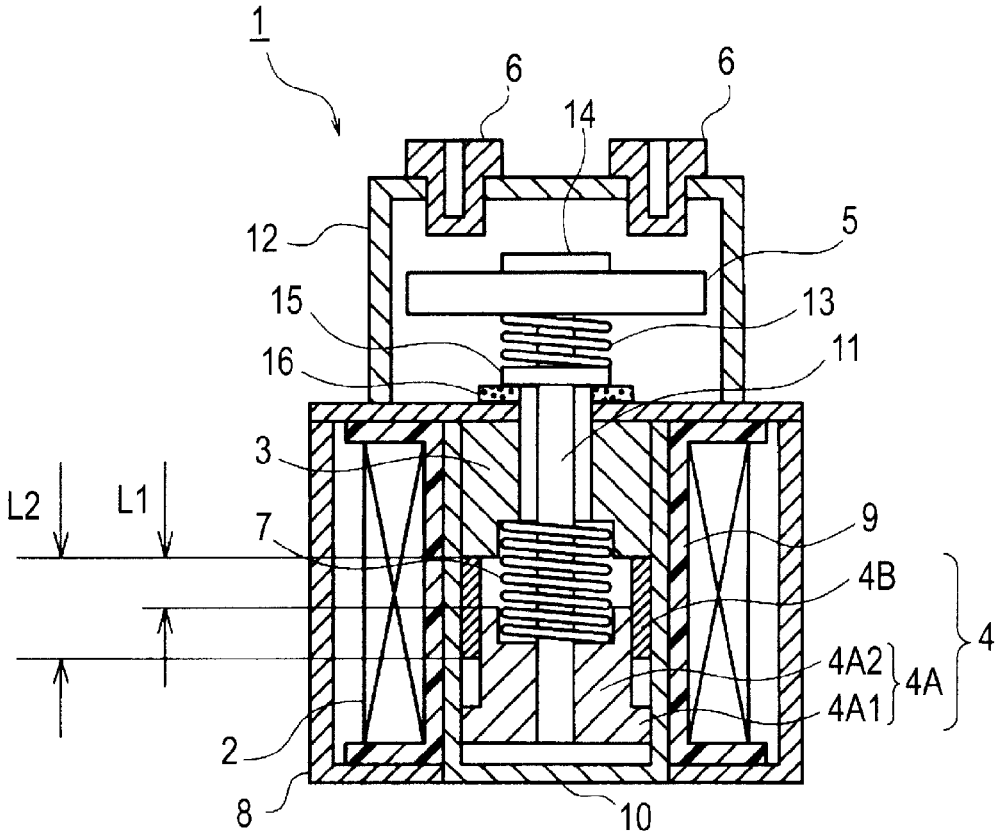
FIG. 2 is an explanatory cross-sectional schematic drawing showing an electro-magnetic relay according to a second embodiment.

A second embodiment will be explained with reference to FIG. 2. In the present embodiment, when a maximum separated distance between the base body 4A and the fixed iron core 3 in the above-explained first embodiment is set to L1 and a height (length) of the movable member 4B in the same is set to L2, an inequality L1<L2 is met as shown in FIG. 2.

By adopting such dimensions, it is prevented for the base body 4A to completely separate away from the movable member 4B when the base body 4A and the fixed iron core 3 are separated away maximally from each other, so that quality and reliability can be improved.

A third embodiment will be explained with reference to FIG. 3. In the present embodiment, a supplemental spring 17 is provided between the movable member 4B and the flange 4A1 of the movable iron core in the above-explained first embodiment. The supplemental spring 17 is compressed while the movable iron core 4 contacts with the fixed iron core 3.

Figure 3:
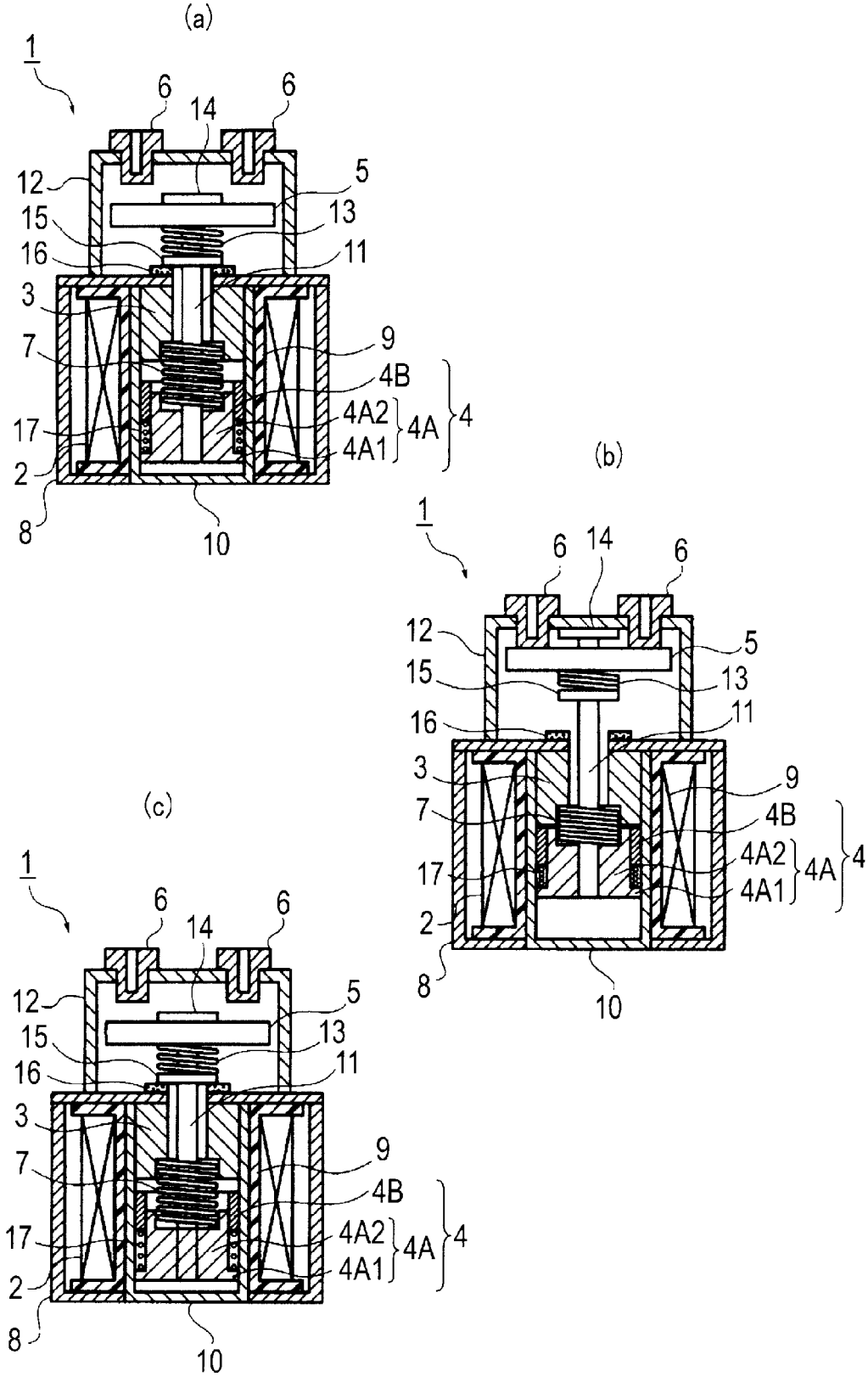
FIG. 3 is an explanatory cross-sectional schematic drawing showing an electro-magnetic relay according to a third embodiment: (a) shows its de-energized state, (b) shows its energization operation and (c) shows its de-energization operation.

According to the above-explained configuration in the present embodiment, the movable member 4B is projected upward from the base body 4A by the supplemental spring 17 as shown in FIG. 3(*a*) while the electromagnetic relay 1 is de-energized. When the electromagnetic relay 1 is energized, both of the base body 4A and the movable member 4B of the movable iron core 4 are attracted to the fixed iron core 3 and then both contact with the iron core 3 as shown in FIG. 3 (*b*). Therefore, the supplemental spring 17 is compressed. When the electromagnetic relay 1 is de-energized from a state shown in FIG. 3(*b*), the base body 4A is quickly separated away from the fixed iron core 3 by the reset spring 7 (and supplemental expanding forces of the pressure-applying spring 13 and the supplemental spring 17), but the movable member 4B still contacts with the fixed iron core 3 at least until the supplemental spring fully expands as shown in FIG. 3(*c*). Therefore, the movable member 4B is surely separated away from the fixed iron core 3 in retard of the base body 4A. In other words, time lag between the base body 4A and the movable member 4B is surely made. Therefore, it is prevented that the movable member 4B dragged by the base body 4A when the base body 4A is separated away from the fixed iron core 3, so that noise and vibration on the de-energization of the electromagnetic relay 1 can be restricted more effectively.

A fourth embodiment will be explained with reference to FIG. 4. In the present embodiment, when a sum of an initial height (length) of the supplemental spring 17 under a de-energized static state of the electromagnetic relay 1 and a height (length) of the movable member 4B in the above-explained third embodiment is set to L3 and a distance between the fixed iron core 3 and an upper surface of the flange 4A1 (i.e. a support plane of the supplemental spring 17) under the de-energized static state in the same is set to L4, an inequality L3<L4 is met as shown in FIG. 4.

Figure 4:
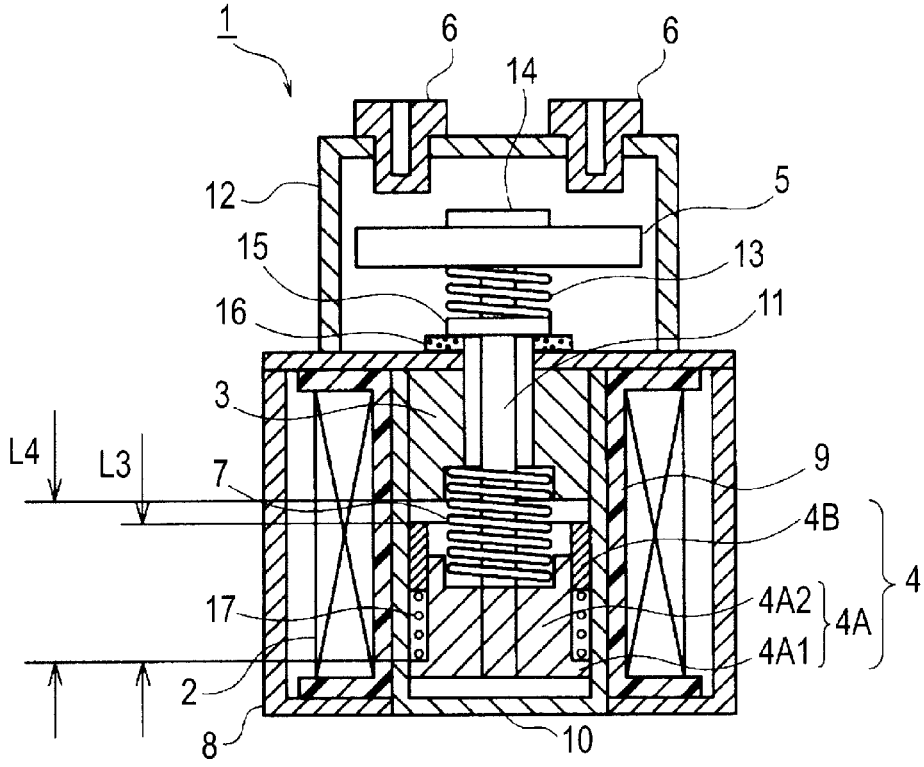
FIG. 4 is an explanatory cross-sectional schematic drawing showing an electro-magnetic relay according to a fourth embodiment.

By adopting such dimensions, it is prevented for the supplemental spring 17 to generate a downward force when the base body 4A and the fixed iron core 3 are separated away maximally from each other (when the base body 4A reaches to its lowermost position as shown in FIG. 4), so that reduction effect of noise and vibration due to the above-mentioned mass reduction is made further enhanced.

Namely, the downward force affecting noise and vibration is caused by a mass of the movable iron core 4 and the expanding force of the reset spring 7 (and other springs 13 and 17). However, if the supplemental spring 17 is still compressed when the base body 4A reaches to its lowermost position, a component of the downward force due to the expansion force of the supplemental spring 17 remains. In this case, reduction effect of noise and vibration will be subject to weaken. This disadvantage is prevented according to the present embodiment, so that reduction effect of noise and vibration is made further enhanced.

Here, the base body 4A starts to separate away from the fixed iron core 3 prior to the movable member 4B on de-energizing the electromagnetic relay 1. Therefore, there is a probability that negative pressure develops near a lower end of the movable member 4B and then sliding movement of the movable member 4B may be disturbed.

Figure 5:
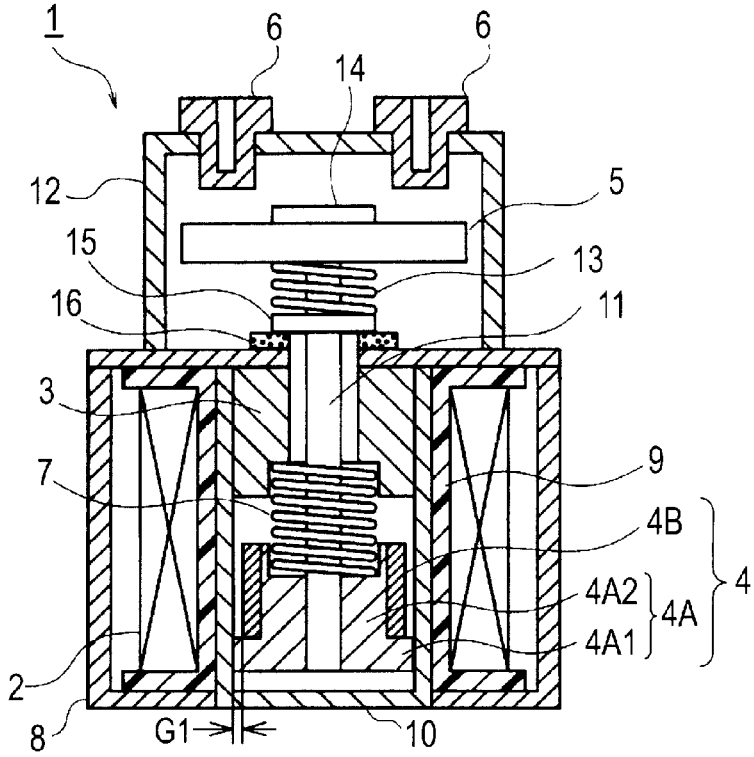
FIG. 5 is an explanatory cross-sectional schematic drawing showing an electro-magnetic relay according to a fifth embodiment.
Figure 6:
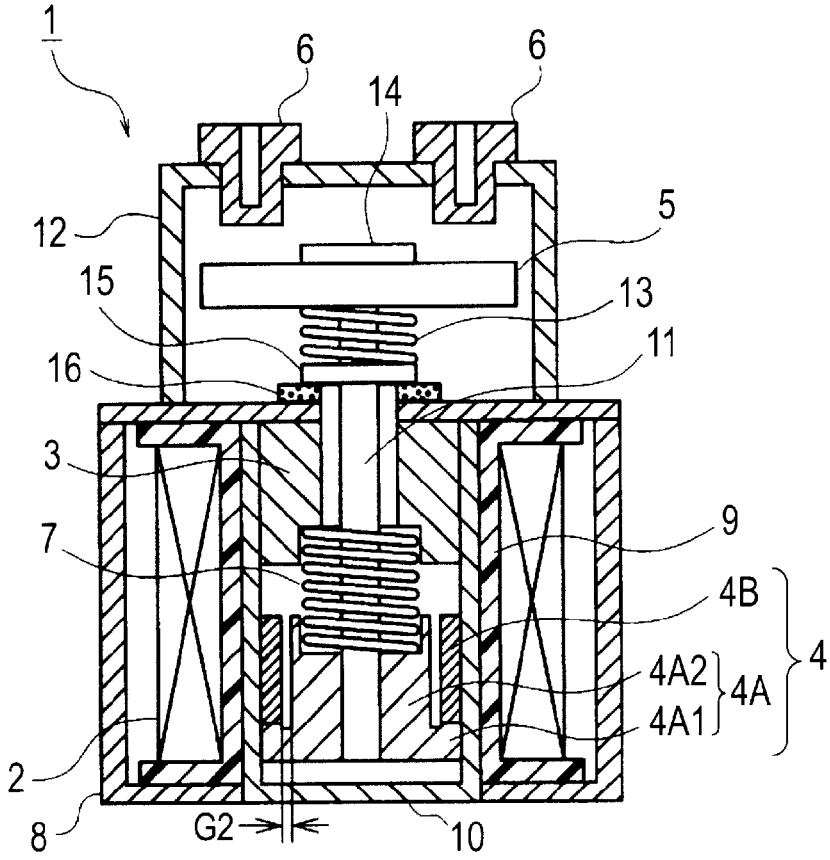
FIG. 6 is an explanatory cross-sectional schematic drawing showing an electro-magnetic relay according to a sixth embodiment.

A fifth embodiment shown in FIG. 5 and a sixth embodiment shown in FIG. 6 aim to avoid the above-mentioned development of negative pressure near the lower end of the movable member 4B on de-energizing the electromagnetic relay 1.

In the fifth embodiment shown in FIG. 5, a gap G1 is formed between an outer circumference of the movable member 4B and the iron core case 10 to allow airflow therethrough.

In the present embodiment, the gap G1 is formed by making the outer diameter of the movable member 4B smaller than an inner diameter of the iron core case 10. However, the Gap G1 may be formed by forming one or more longitudinal grooves on the outer circumference of the movable member 4B in the axial direction instead of making the outer diameter of the movable member 4B smaller.

In a case where the gap G1 is formed by adjusting only the movable member 4B as shown in FIG. 5 or by adjusting the fundamental outer diameter of the movable iron core 4, chattering of the movable member 4B is prevented by setting a dimension relating to a slidably-contacting portion between an inner diameter of the movable member 4B and an outer diameter of the small-diameter portions 4A2 within tolerance for coupling them.

According to the present embodiment, while the base body 4A is quickly separated away from the fixed iron core 3 on de-energizing the electromagnetic relay 1, a space between the lower end of the movable member 4B and the flange 4A1 communicates with an upper space and/or a lower space of the movable iron core 4 through the gap G1 at its initial stage to allow airflow therebetween.

As a result, the development of negative pressure near the lower end of the movable member 4B is avoided, so that the movable member 4B can be made separated from the fixed iron core 3 in retard of the base body 4A.

In the sixth embodiment shown in FIG. 6, a gap G2 is formed between the movable member 4B and the small-diameter portion 4A2 of the base body to allow airflow therethrough.

In the present embodiment, the gap G2 is formed by making an outer diameter of the small-diameter portion 4A2 smaller than an inner diameter of the movable member 4B. However, the Gap G2 may be formed by forming one or more longitudinal grooves on an inner circumference of the movable member 4B or on an outer circumference of the small-diameter portion 4A2 in the axial direction without making a whole outer diameter of the small-diameter portion 4A2 smaller than an inner diameter of the movable member 4B.

In a case where the gap G2 is formed by adjusting the outer diameter of the small-diameter portion 4A2 as shown in FIG. 6, chattering of the movable member 4B is prevented by setting a dimension relating to a slidably-contacting portion between an inner diameter of the iron core case 10 and an outer diameter of the movable member 4B within tolerance for coupling them.

According also to the present embodiment, a space between the lower end of the movable member 4B and the flange 4A1 communicates with an upper space of the movable iron core 4 through the gap G2 to allow airflow therebetween at the initial stage of separation of the base body 4A on de-energizing the electromagnetic relay 1.

As a result, similarly to the above-explained fifth embodiment, the development of negative pressure near the lower end of the movable member 4B is avoided, so that the movable member 4B can be made separated from the fixed iron core 3 in retard of the base body 4A.

Although the electromagnetic relay 1 in the fifth or sixth embodiment has a basic structure same as in that in the first embodiment, the above-explained supplemental spring 17 may be further applied to that in the fifth or sixth embodiment. In this case, advantages by adopting the supplemental spring 17 can be achieved in the fifth or sixth embodiment.

Note that configuration of the electromagnetic relay 1 is not limited to that in the above embodiments. The configuration may be modified, if the base body 4A and the movable member 4B are integrally attracted to the fixed iron core 3 on energizing the electromagnetic relay 1 and the base body 4A is separated away from the fixed iron core 3 by the expanding force of the reset spring 7 prior to the movable member 4B on de-energizing the electromagnetic relay 1. For example, it may be modified how to divide the movable iron core 4 into the base body 4A and the movable member 4B, or how/where the reset spring 7 is disposed.

The entire contents of Japanese Patent Applications 2010-140321 (filed Jun. 21, 2010) and 2011-96197 (filed Apr. 22, 2011) are incorporated herein by reference. Note that the Application 2011-96197 is filed based on a domestic priority from the Application 2010-140321.

Although the invention has been described above by reference to certain embodiments of the invention, the invention is not limited to the embodiments described above. Modifications and variations of the embodiments described above will occur to those skilled in the art, in light of the above teachings.

The invention claimed is:

1. An electromagnetic relay comprising:

a fixed iron core;

a movable iron core that is disposed opposing to the fixed iron core and can contact-with or separate-from the fixed iron core along an axial direction;

a coil that surrounds the fixed iron core and the movable iron core and generates a magnetic force when energized to make the movable iron core attracted by the fixed iron core;

a movable contact coupled with the movable iron core;

a fixed contact that is disposed opposing to the movable contact and can be contacted-with or distanced-from the movable contact along with a movement of the movable iron core: and a reset spring that is interposed between the fixed iron core and the movable iron core and separates the movable iron core from the fixed iron core when the coil is de-energized, wherein the movable iron core includes a base body to which an expanding force of the reset spring is applied and a movable member that is provided independently from the base body, and the movable member is configured to be moved to the fixed iron core integrally with the base body in the axial direction when the coil is energized, and to move in the axial direction to slide independently from the base body when the coil is de-energized.

2. The electromagnetic relay according to claim 1, wherein, when a maximum separated distance between the base body and the fixed iron core is set to L1 and a length of the movable member is set to L2, an inequality L1<L2 is met.

3. The electromagnetic relay according to claim 1, wherein the movable member is coupled with the base body concentrically and can slide in the axial direction relative to the base body, and the relay further comprises a supplemental spring that is disposed between the movable member and the base body and compressed when the movable iron core contacts with the fixed iron core.

4. The electromagnetic relay according to claim 3, wherein, when a sum of an initial length of the supplemental spring under a de-energized static state of the electromagnetic relay and a length of the movable member is set to L3 and a distance between the fixed iron core and a support plane of the base body that supports an end of the supplemental spring under the de-energized static state is set to L4, an inequality L3<L4 is met.

5. The electromagnetic relay according to claim 1, wherein the movable member is coupled with the base body concentrically to surround the base body and can slide in the axial direction relative to the base body, the movable member slidably-contacts with an outer circumference of the base body, and a gap for allowing airflow therethrough is formed between an outer circumference of the movable member and an iron core case within which the fixed iron core and the movable iron core are disposed.

6. The electromagnetic relay according to claim 1, wherein the movable member is coupled with the base body concentrically to surround the base body and can slide in the axial direction relative to the base body, and a gap for allowing airflow therethrough is formed between the movable member and the base body.

* * * * *